US005653169A

United States Patent [19]

Puschnerat et al.

[11] Patent Number: 5,653,169

[45] Date of Patent: Aug. 5, 1997

[54] RUBBER BLANKET CYLINDER FOR OFFSET PRINTING

[75] Inventors: Helmut Puschnerat, Wachenheim; Peter Schröder, Hessheim, both of Germany

[73] Assignee: Koenig & Bauer-Albert Aktiengesellschaft, Wurzburg, Germany

[21] Appl. No.: 577,341

[22] Filed: Dec. 22, 1995

[30] Foreign Application Priority Data

Dec. 30, 1994 [DE] Germany ..... 44 47 179.3

[51] Int. Cl.[6] ..... B41F 1/28

[52] U.S. Cl. ..... 101/415.1; 101/389.1

[58] Field of Search ..... 101/415.1, 389.1, 101/142; 428/909

[56] References Cited

U.S. PATENT DOCUMENTS

| | | | |
|---|---|---|---|
| 3,730,092 | 5/1973 | Pickard et al. . | |
| 4,833,986 | 5/1989 | Kobler | 101/415.1 |
| 4,854,237 | 8/1989 | Theilacker | 101/415.1 |
| 5,136,945 | 8/1992 | Kawazoe | 101/389.1 |
| 5,209,163 | 5/1993 | Banike | 101/483 |
| 5,357,863 | 10/1994 | McLean et al. | 101/389.1 |
| 5,473,407 | 12/1995 | Fuchioka et al. | 355/47 |

FOREIGN PATENT DOCUMENTS

| | | |
|---|---|---|
| 28 03 908 | 8/1979 | Germany . |
| 38 32 515 | 4/1990 | Germany . |
| 2 016 373 | 9/1979 | United Kingdom . |
| WO93/09952 | 5/1993 | WIPO . |

*Primary Examiner*—Edgar S. Burr
*Assistant Examiner*—Dave A. Ghatt
*Attorney, Agent, or Firm*—Jones, Tullar & Cooper, P.C.

[57] ABSTRACT

A rubber blanket cylinder for offset printing utilizes a cylinder body that has magnetic strips to retain a rubber blanket packing comprised of a rubber blanket and a ferromagnetic rubber blanket support. A fastening strip is positioned on the circumference of the cylinder body and extends axially along the cylinder. The rubber blanket packing is prevented from wandering or shifting by the fastening strip. A free end of the fastening strip is covered by the rubber blanket which is thus fastened on the cylinder body in an essentially gap-free manner.

15 Claims, 2 Drawing Sheets

RUBBER BLANKET CYLINDER FOR OFFSET PRINTING

FIELD OF THE INVENTION

The present invention is directed generally to a rubber blanket cylinder for offset printing. More specifically, the present invention is directed to a rubber blanket cylinder for offset printing which receives a rubber blanket packing. Most specifically, the present invention is directed to a rubber blanket cylinder having a fastening strip or strips usable to prevent migration of the rubber blanket packing on the blanket cylinder. The rubber blanket packing includes an outer rubber blanket and an inner blanket support. This blanket support may be a ferromagnetic material which is held on the surface of the blanket cylinder by magnetic strips placed in the cylinder. At least one fastening strip or a plurality of individual fastening strips are utilized to insure that the rubber blanket packing is held in one place on the surface of the blanket cylinder and does not shift or wander as the blanket cylinder rotates.

DESCRIPTION OF THE PRIOR ART

In the field of rotary printing, it is generally well known to utilize rubber covered cylinders. These rubber blanket cylinders are used in letter press printing, in offset printing, and in various other applications. The rubber blanket cylinder is typically a solid or hollow metal cylinder that has a rubber or other resilient blanket or sleeve attached to it. In some instances the attachment may be permanent while in others, the rubber blanket or cover may be removable. Such a removal of the rubber blanket from the cylinder is very desirable in many instances. There are various ways in which the rubber blanket has previously been secured to the cylinder. Often these securement arrangements include grooves or slots in the cylinder, and blankets with tongues that are inserted in the slot.

One rubber blanket cylinder arrangement is shown in published international Application WO 93/09952. In this device, the rubber blanket is attached to a ferromagnetic rubber blanket support. The blanket and the blanket support form a rubber blanket packing which is fastened to the blanket cylinder, in part, by the provision of a magnetic cylinder body which holds the ferromagnetic rubber blanket support. The blanket support is also provided with a beveled end that is received in a gap in the magnetic cylinder body.

Rubber blanket cylinders of this type have several limitations. A first of these is the utilization of a cylinder groove or slot and a cooperating beveled end on the rubber blanket support. This causes a discontinuity in the surface of the blanket cylinder. The existence of such a discontinuous area imposes limitations on the usefulness of the rubber blanket cylinder and also may result in the occurrence of vibration or rough running of the cylinders.

If the press is reversible in its direction of operation, the cylinder groove will have to be structured so that it will engage and hold the leading end of the rubber blanket support in either direction of cylinder rotation. This increases the cost and complexity of the assembly.

The mere reliance on the magnetic cylinder body may not be sufficient in all instances. Particularly in offset printing wherein the rubber blanket cylinder transfers the inked image to the substrate to be printed, it is important that the rubber blanket be securely affixed to the blanket cylinder body. The mere use of a ferromagnetic material and a magnetic cylinder body may not be sufficient to hold the blanket in place so that it will not slip or rotate with respect to the cylinder.

It will thus be seen that a need exists for a rubber blanket cylinder that overcomes the limitations of the prior art devices. The rubber blanket cylinder for offset printing in accordance with the present invention, provides such a device and is a significant improvement over the prior art.

SUMMARY OF THE INVENTION

It is an object of the present invention to provide a rubber blanket cylinder for offset printing.

Another object of the present invention is to provide a rubber blanket cylinder for offset printing which receives a rubber blanket packing.

A further object of the present invention is to provide a rubber blanket cylinder for offset printing that has one or more fastening strips on the peripheral surface of the cylinder.

Still another object of the present invention is to provide a rubber blanket cylinder which uses a ferromagnetic rubber blanket support and a fastening strip to hold the rubber blanket packing secure against movement.

Even yet a further object of the present invention is to provide a rubber blanket cylinder whose direction of rotation can be reversed.

As will be set forth in detail in the description of the preferred embodiments which is presented subsequently, the rubber blanket cylinder for offset printing in accordance with the present invention receives a rubber blanket packing which consists of a rubber blanket and a ferromagnetic rubber blanket support. A plurality of magnetic strips or inserts are situated on the surface of the cylinder body. These magnetic strips attract the ferromagnetic rubber blanket support. In addition, the cylinder body is provided with at least a single fastening strip that extends generally parallel to the axis of rotation of the cylinder and which projects out from the peripheral surface of the cylinder body. This fastening strip may be inclined in the circumferential direction of the cylinder body.

The rubber blanket cylinder of the present invention overcomes the limitations of the prior art devices. The cylinder body has no slot, groove, or channel into which an end of the rubber blanket support must be inserted. This reduces the complexity of the cylinder and avoids the cause of various cylinder vibrations or rough running problems. The outer surface of the rubber blanket is essentially smooth and continuous and thus, particularly in offset printing, is much more usable.

The fastening strip extends out from the peripheral surface of the cylinder body and is secured between the leading and trailing ends of the rubber blanket. This fastening strip acts to prevent wandering or shifting of the rubber blanket and its rubber blanket support. Any excursions of the rubber blanket support on the surface of the rubber blanket cylinder in either the axial or the circumferential directions are made impossible since the rubber blanket support is engaged along the length of the blanket cylinder by the fastening strip or strips.

By use of this rubber blanket support, a reduced specific surface pressure is created at the front surface of the rubber blanket support. The thickness of the material used for the rubber blanket support can be reduced because of this.

The rubber blanket support does not have to be provided with a beveled edge or end because, as discussed above, there is no slot or groove into which this end must fit. Since the support is unbeveled at its ends, the two ends of the blanket cylinder can be placed directly against each other. This type of orientation is virtually impossible to properly obtain when beveled rubber blanket supports are being used. Since the two ends of the blanket can essentially touch each other, the result is a practically gap-free rubber blanket that is applied to the blanket cylinder and that is yet easy to remove.

In the course of each rotation of the rubber blanket cylinder, the rubber blanket is flexed slightly and forms a stabilizing wave. As this traveling or flexing wave passes over the point of separation of the leading and the trailing ends of the rubber blanket, these ends are caused to move even closer to each other. Thus any gap that might exist between the leading and trailing edges of the rubber blanket will tend to be closed. The inner surfaces of both the start and end of the rubber blanket can be recessed in such a way that the upper portions of the blanket can rest on a front face of the fastening strip.

The rubber blanket cylinder for offset printing in accordance with the present invention overcomes the limitations of the prior art. It is a substantial advance in the art.

BRIEF DESCRIPTION OF THE DRAWINGS

While the novel features of the rubber blanket cylinder for offset printing are set forth with particularity in the appended claims, a full and complete understanding of the invention may be had by referring to the detailed description of the preferred embodiments which are presented subsequently, and as illustrated in the accompanying drawings, in which:

DETAILED DESCRIPTION OF THE PREFERRED EMBODIMENTS

Figure 1:
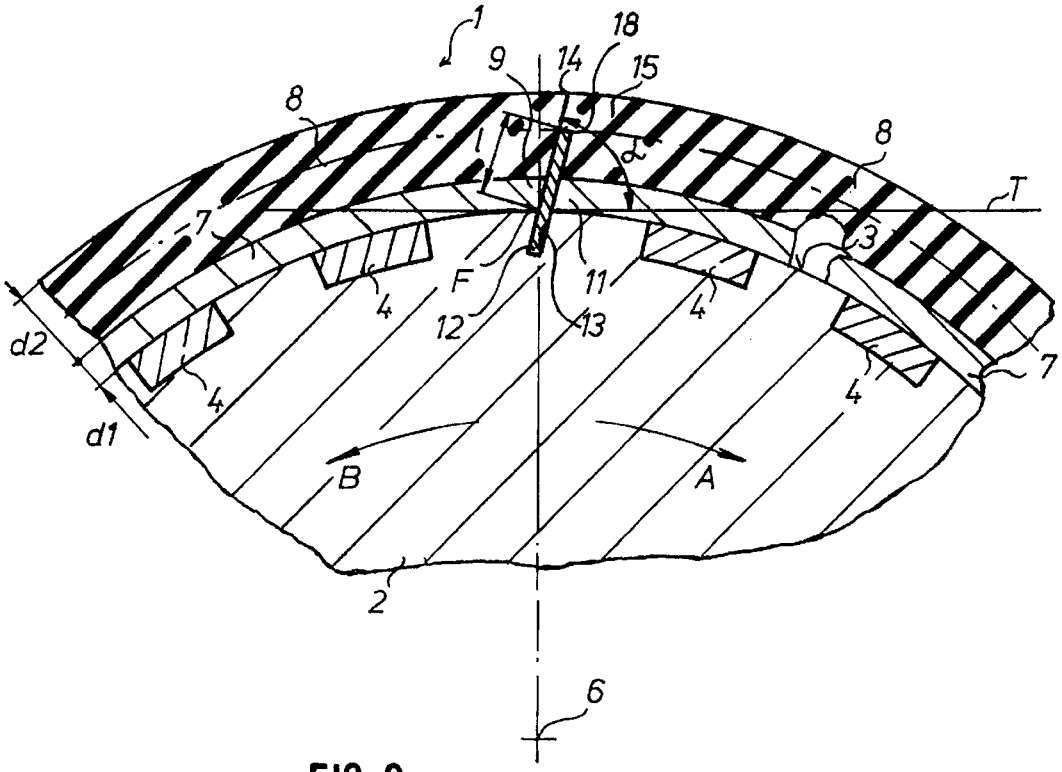
FIG. 1 is a cross-sectional view through a portion of a cylinder body provided with magnets, with a rubber blanket start and with a first preferred embodiment of a fastening strip in accordance with the present invention.

Referring initially to FIG. 1, there may be seen, generally at 1, a first preferred embodiment of a rubber blanket cylinder for offset printing in accordance with the present invention. Rubber blanket cylinder 1 consists of a cylinder body 2 having, for example, a number of strip-shaped magnets 4 on its circumference or its surface 3. The long axes of these magnets 4 extend concentrically with respect to an axis of rotation 6 of the rubber blanket cylinder 1.

A rubber blanket packing can be placed on the surface 3 of the cylinder body 2 and consists of, for example, a ferromagnetic rubber blanket support 7 of a thickness d1 and a rubber blanket 8 of a greater thickness d2. The rubber blanket 8 is irremovably connected with the rubber blanket support 7. It is also possible to structure the cylinder body 2 without magnets 4 and instead to make the rubber blanket support 7 of a magnetized flexible material, for example of so-called magnetic rubber.

A fastening strip 12 is located in a gap or groove 14 on the surface 3 of cylinder 1. Fastening strip 12 extends axially along the cylinder surface 3 parallel to the axis of rotation 6 and is positioned between a start 9 of the rubber blanket packing 7 and 8 and an end 11 of the rubber blanket packing 7 and 8. Fastening strip 12 projects out radially from the peripheral or circumferential surface 3 of the cylinder body 2 and is disposed inclined in the circumferential direction, for example, viewed in the clockwise turning direction A of the cylinder 1. The start 9 and the end 11 of the rubber blanket support 7 abut against the side faces of the fastening strip 12. The fastening strip 12 which, as was discussed above, extends in direction parallel to the axis 6 of the cylinder body 2, can be made of sheet steel and can be clamped by known means in the groove 13 of the cylinder body 2. The fastening strip 12 projects generally radially out away from of the surface 3 of the cylinder body 2 by a free length amount 1, and has a free outer end 18. The free length 1 of the strip 12 corresponds at least to the thickness d1 of the rubber blanket support 7, but preferably corresponds to two-thirds of the thicknesses d1 and d2 of the rubber blanket packing 7 and 8. The inclination of the fastening strip 12 in the direction of rotation A of the cylinder 1 extends at an acute angle $\alpha$ with respect to a tangential line T on the surface 3 of the cylinder body 2 passing through a foot F of the fastening strip 12. The angle $\alpha$ preferably lies in a range between 75° and 89.9°. Because of the rotation of the rubber blanket cylinder in the clockwise direction A, as shown in FIG. 1 during the printing process, the rubber blanket packing 7 and 8 tries to "wander", or to move or shift in a direction opposite to the direction of rotation A, i.e. in a counterclockwise direction B. The rubber blanket support 7 is not capable of accomplishing this shifting, since the end 11 of the rubber blanket support 7 pushes against the fastening strip 12 and cannot rise or elevate in the radial direction. This movement is prevented by the fastening strip 12 projecting out of the rubber blanket cylinder at the angle of inclination $\alpha$.

The very small gap 14 located between the start 9 and the end 11 of the rubber blanket 8 is dimensioned in such a way that the start 9 and the end 11 of the rubber blanket 8 abut closely against each other. The free end 18 of the fastening strip 12 is covered by an upper or outer layer 15 of the end 11, or possibly also of the start 9 of the rubber blanket 8. The end 11 or the start 9 of the rubber blanket 9 is recessed to accommodate the thickness and height of the fastening strip 12 over the length of the fastening strip 12 as seen in FIG. 1. If the rubber blanket cylinder 1 is to be rotated in the counterclockwise direction B, it is necessary to dispose the fastening strip 12 on the cylinder body 2 so it is inclined at an acute angle $\alpha$ in the direction of rotation B. This may be achieved by the provision of a separate groove, not shown, into which the fastening strip 12 can be placed. The start 9 and the end 11 of the rubber blanket packing 7 and 8 are also reversed in the course of a reversal of the direction of rotation of the cylinder body 2. Preferably the magnets 4 can be disposed in the surface 3 of the cylinder body 2 only in the vicinity and on both sides of the groove 13, and are usable, in particular, for holding the start 9 and the end 11 of the rubber blanket packing 7, 8 on the cylinder body 2.

Figure 2:
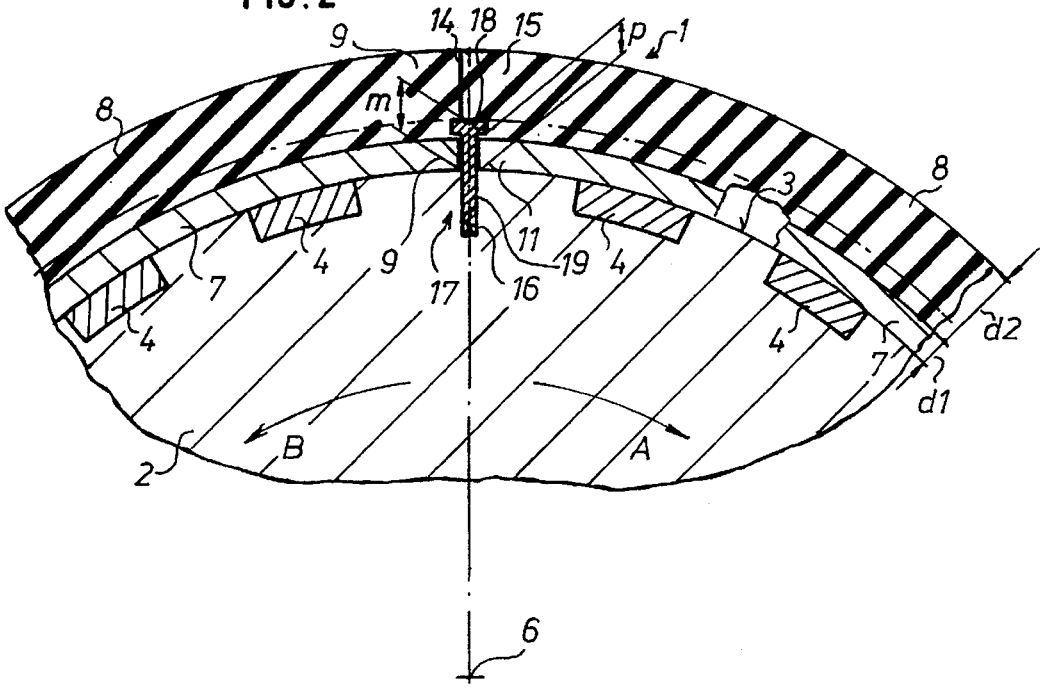
FIG. 2 is a view similar to FIG. 1 and showing a second preferred embodiment of a fastening strip.

Turning now to FIG. 2, there may be seen a second preferred embodiment of a rubber blanket cylinder for offset printing in accordance with the present invention. In this second embodiment of the rubber blanket cylinder 1, in which the same reference numbers are used for similar elements, a profiled fastening strip 17 is disposed in a groove 16 of the cylinder body 2. This profiled fastening strip 17 which, in cross section, projects in the radial direction out of the surface 3 of the cylinder body 2, is provided with a free height "m" and extends, in the axis-parallel direction, along the entire length of the cylinder body 2. The fastening strip 17, as seen in FIG. 2, consists of a strip ridge 19 having a strip head 18. Fastening strip 17 thus has a T-profile and is protruding at a distance "p" and is spaced apart from the surface 3 of the cylinder 1. The free height "m" of the fastening strip 17 is dimensioned in such a way, that a distance "p" between the underside of the strip head 18 and the surface 3 of the cylinder body 2 is slightly greater by, for example, approximately 0.1 mm than the thickness d1 of the rubber blanket support 7. In this second embodiment the rubber blanket 8, which is in close proximity to the strip head 18 of the fastening strip 17, can be recessed so that the fastening strip 17 is covered by an upper or outer layer 15 of the rubber blanket 8, as may be seen in FIG. 2. This cooperative structure assures that during the operational state of the rubber blanket cylinder 1, regardless of its direction of rotation, wandering of the rubber blanket packing on the cylinder body 2 is prevented. At the same time, the gap 14 located between the start 9 and the end 11 of the rubber blanket 8 is of such a reduced size that it approaches zero. The start 9 and the end 11 of the rubber blanket packing 7 and 8 are interchanged when the direction of rotation of the cylinder 1 is reversed. In case only one direction of rotation of the rubber blanket cylinder 1 is contemplated, the disposition of a fastening strip 17, which is embodied hook-shaped in profile is sufficient. In such a configuration, the strip head 18, i.e. the horizontal portion of the hook, always points in the direction of the end 11 of the rubber blanket packing 7 and 8. A strip head of the profiled fastening strip 17 can also have the profile of a quarter of a letter O, which then also resembles a hook shape.

Figure 3:
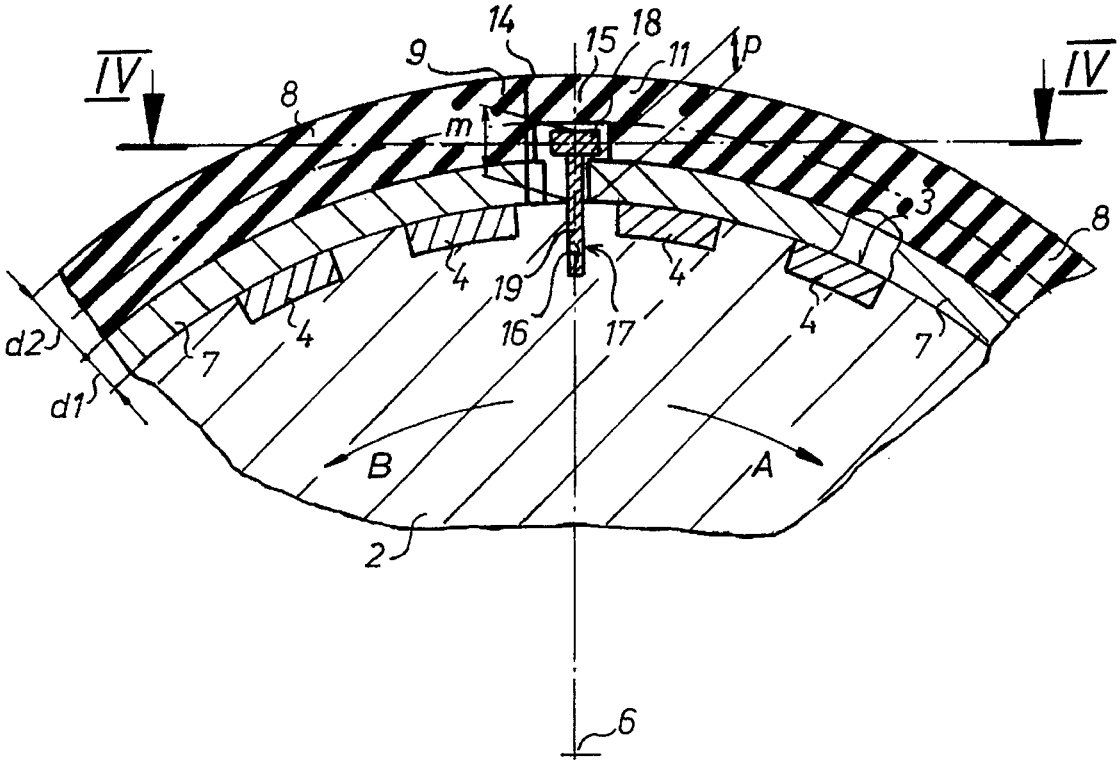
FIG. 3 is a view analogous to FIGS. 1 and 2 and showing a third preferred embodiment of a fastening strip in accordance with the present invention.
Figure 4:
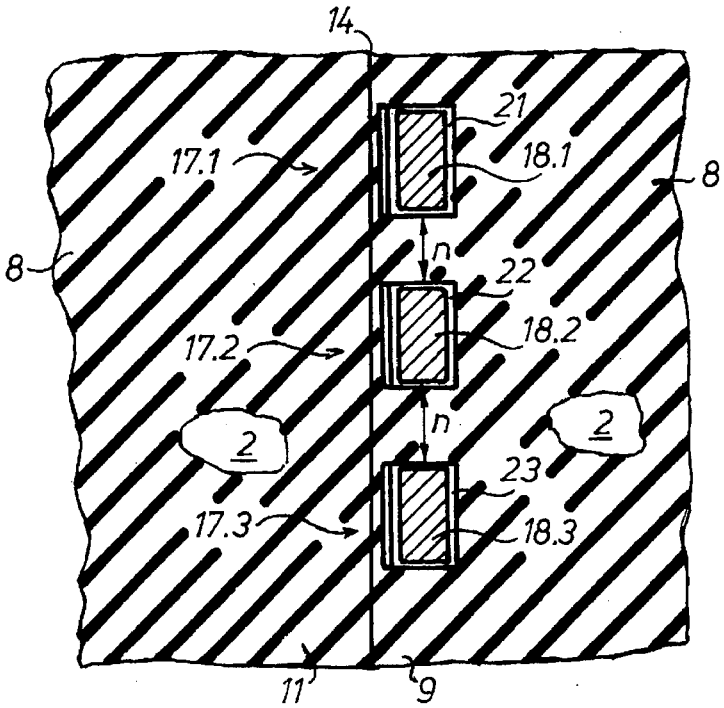
FIG. 4 is a sectional top view of the cylinder of FIG. 3 taken along line IV—IV of FIG. 3.

In a third embodiment of the rubber blanket cylinder 1 in accordance with the present invention, in which similar elements are identified by the same reference numbers, the fastening strip 17, represented in FIG. 2 as a single elongated member, is divided into a plurality of profiled fastenings 17.1, 17.2, 17.3, which are spaced apart from each other, as seen in FIG. 4, and which extend in an axis-parallel direction over the length of the cylinder body 2. The free ends 18.1, 18.2, 18.3 of the strip heads of the fastenings 17.1 to 17.3 are also embodied to be T-shaped in profile. If only one direction of rotation of the rubber blanket cylinder 1 is contemplated, it is also sufficient, as has already described in connection with FIG. 3, that the fastening strip 17 or the fastenings 17.1 to 17.3 are embodied hook-shaped or the like in their profile, so that the strip head is hook-shaped instead of T-shaped.

The rubber blanket packing, consisting of the rubber blanket support 7 and the rubber blanket 8, has perforations 21, 22 and 23 at an inner surface portion of its end 11. These perforations 21, 22 and 23 extend in the axis-parallel direction 6 and correspond with the fastenings 17.1 to 17.3. This means that, when mounting the rubber blanket packing 7 and 8, on the cylinder body 2, that the end 11 of the packing which is pointing opposite to the clockwise direction of rotation A of the rubber blanket cylinder 1 is brought over the free ends 18.1 to 18.3 of the fastenings 17.1 to 17.3. Its perforations 21 to 23 engage the fastenings 17.1 to 17.3 and this end 11 is anchored opposite the clockwise direction of rotation A. This is accomplished by placing the rubber blanket support 7, with its perforations 21 to 23, on the radial portion of the fastenings 17.1 to 17.3 underneath the underside of the free ends 18.1 to 18.3 of the T-profile. It is now possible to place the start of the rubber blanket 8 in a known manner on the surface 3 of the cylinder body 2. The rubber blanket 8 is appropriately recessed in the vicinity of the T-shaped free ends 18.1 to 18.3, but is closed in the direction toward the outer layer 15 of the rubber blanket 8. This insures that the outer surface of the rubber blanket cylinder 1 is smooth and uninterrupted.

As may be seen in FIG. 4, the spacing distance "n" between the fastenings 17.1 to 17.3 preferably has a length up to the length of the fastenings 17.1 to 17.3. In case of a necessary reversal of the direction of rotation of the rubber blanket cylinder 1, the rubber blanket packing 7 and 8 will be re-hung, so that the start 9 of the rubber blanket always points in the direction of rotation of the rubber blanket cylinder 1.

It is also possible, in connection with the third embodiment of the rubber blanket cylinder 1, to change the direction of rotation of the rubber blanket cylinder 1, for example into a counterclockwise direction of rotation B, without "rehanging" the rubber blanket packing 7, 8. This means that the perforations 21 to 23 are now at the start 9 of the rubber blanket packing 7, 8. With an embodiment of the fastenings 17.1 to 17.3 which is T-shaped in profile, and independently of the direction of rotation of the rubber blanket cylinder 1, the overlapping of the free ends 18.1 to 18.3 over the perforations 21 to 23 of the rubber blanket support 7 is always assured.

While preferred embodiments of a rubber blanket cylinder for offset printing in accordance with the present invention have been set forth fully and completely hereinabove, it will be apparent to one of skill in the art that a number of changes in, for example, the overall size of the cylinder, the drive arrangement for the cylinder, the type of medium being printed and the like may be made without departing from the true spirit and scope of the present invention which is accordingly to be limited only by the following claims.

What is claimed is:

1. A rubber blanket cylinder comprising:

a cylinder body having a peripheral surface;

a rubber blanket packing consisting of an outer rubber blanket and a rubber blanket support, said rubber blanket packing having a start and an end;

means for fastening said rubber blanket packing on said cylinder body by magnetic force; and a fastening strip on said cylinder body, said fastening strip projecting generally radially out from said peripheral surface portion of said cylinder body and extending along said cylinder body peripheral surface in a direction parallel to an axis of rotation of said cylinder body, said fastening strip having side faces and being inclined in a circumferential direction of said cylinder body, said rubber blanket packing start and end abutting said side faces of said fastening strip.

2. A rubber blanket cylinder comprising:

a cylinder body having a peripheral surface;

a rubber blanket packing consisting of an outer rubber blanket and a rubber blanket support, said rubber blanket packing having a start and an end;

means for fastening said rubber blanket packing on said cylinder body by magnetic force; and a fastening strip on said cylinder body, said fastening strip projecting radially out from said perpheral surface portion of said cylinder body and extending along said cylinder body peripheral surface parallel to an axis of rotation of said cylinder body, said fastening strip having side faces with a strip head located on a strip ridge with said strip head being spaced at a first spacing distance radially outwardly from said surface portion of said cylinder body, said rubber blanket packing start and end abutting said side faces of said fastening strip.

3. The rubber blanket cylinder of claim 1 wherein said fastening strip has a foot portion received in said cylinder body and further wherein said fastening strip is inclined at an acute angle with respect to a line tangent to said surface portion of said cylinder body and passing through said foot of said fastening strip.

4. The rubber blanket cylinder of claim 2 wherein said fastening strip is divided into a plurality of individual fastenings which are spaced apart from each other.

5. The rubber blanket cylinder of claim 2 wherein said rubber blanket support has a plurality of perforations extending along a start of said rubber blanket support generally parallel to an axis of rotation of said cylinder body, said perforations being interlockingly connectable with said strip head.

6. The rubber blanket cylinder of claim 1 wherein the height of said fastening strip projecting out of said surface of said cylinder body is greater than the thickness of said rubber blanket support.

7. The rubber blanket cylinder of claim 1 wherein said means for fastening said rubber blanket packing on said cylinder body includes magnets inserted in said surface of said cylinder body adjacent said start and end of said rubber blanket packing positioned on said cylinder body.

8. The rubber blanket cylinder of claim 2 wherein said means for fastening said rubber blanket packing on said cylinder body includes magnets inserted in said surface of said cylinder body adjacent said start and end of said rubber blanket packing positioned on said cylinder body.

9. The rubber blanket cylinder in accordance with claim 7 wherein said rubber blanket support is a ferromagnetic material.

10. The rubber blanket cylinder in accordance with claim 8 wherein said rubber blanket support is a ferromagnetic material.

11. The rubber blanket cylinder of claim 1 wherein said rubber blanket is a magnetic flexible material and further wherein said cylinder body is metal.

12. The rubber blanket cylinder of claim 2 wherein said rubber blanket is a magnetic flexible material and further wherein said cylinder body is metal.

13. The rubber blanket cylinder of claim 1 wherein an end of said fastening strip projecting out from said surface of said cylinder body is covered by an outer layer of said rubber blanket of said rubber blanket packing.

14. The rubber blanket cylinder of claim 2 wherein said fastening strip is T-shaped in profile.

15. A rubber blanket cylinder comprising:

a cylinder body having a peripheral surface;

a rubber blanket packing consisting of an outer rubber blanket and a rubber blanket support;

means for fastening said rubber blanket packing on said cylinder body by magnetic force; and a fastening strip projecting out of said peripheral surface of said cylinder body and extending in a direction parallel to an axis of rotation of said cylinder body, said fastening strip being inclined in a circumferential direction of said cylinder body, the height of said fastening strip projecting out of said surface of said cylinder body being greater than the thickness of said rubber blanket support.

* * * * *